United States Patent [19]

Peters et al.

[11] 4,154,203

[45] May 15, 1979

[54] FUEL INJECTION SYSTEM

[75] Inventors: Klaus-Jürgen Peters, Affalterbach; Hermann Nusser, Asperg, both of Fed. Rep. of Germany

[73] Assignee: Robert Bosch GmbH, Stuttgart, Fed. Rep. of Germany

[21] Appl. No.: 816,843

[22] Filed: Jul. 18, 1977

[30] Foreign Application Priority Data

Aug. 20, 1976 [DE] Fed. Rep. of Germany ..... 2637465

[51] Int. Cl.[2] ..... F02M 39/00

[52] U.S. Cl. ..... 123/139 AW; 123/139 BG; 123/119 R; 261/44 A; 261/44 F

[58] Field of Search ..... 123/139 AW, 139 BG, 123/139 AT, 139 BC, 139 AF, 119 R; 261/44 A, 44 F, 44 R

[56] References Cited

U.S. PATENT DOCUMENTS

| | | | |
|---|---|---|---|
| 2,759,468 | 8/1956 | Powell et al. | 123/139 AW |
| 2,955,583 | 10/1960 | Dahl et al. | 123/119 R |
| 3,970,065 | 7/1976 | Kaibara et al. | 123/139 BG |
| 4,064,843 | 12/1977 | Holzbaur | 123/139 AW |
| 4,064,847 | 12/1977 | Holzbaur et al. | 123/139 BC |
| 4,079,718 | 3/1978 | Holzbaur | 123/139 AW |

FOREIGN PATENT DOCUMENTS

| | | | |
|---|---|---|---|
| 154158 | 2/1922 | United Kingdom | 261/44 A |

*Primary Examiner*—Charles J. Myhre
*Assistant Examiner*—Andrew M. Dolinar
*Attorney, Agent, or Firm*—Edwin E. Greigg

[57] ABSTRACT

A pivoting member, especially the air flow rate meter of an internal combustion engine is disposed in a hub which surrounds a locally fixed shaft and is positioned in the induction tube upstream of the throttle valve. The shaft is received in a plurally perforated bearing portion formed integral with the wall of the induction tube. The axial perforation in the bearing receives a tubular element with fuel being fed about the exterior wall thereof to a metering valve and surplus fuel arranged to flow through the tubular element to a pressure control valve.

6 Claims, 6 Drawing Figures

FUEL INJECTION SYSTEM

BACKGROUND OF THE INVENTION

The invention relates to a mechanism comprising an induction tube of an internal combustion engine and in which is disposed a pivotal air flow meter and an operator controlled throttle valve. The air flow meter is moved against a restoring force in accordance with the quantity throughflow and the movable component of a valve disposed in the fuel line for apportionment of a fuel quantity proportional to the given air quantity is accordingly displaced. The presently known devices are incapable of current requirements of mass production and assembly line installation. This invention is intended to fill the void in the prior art.

OBJECT AND SUMMARY OF THE INVENTION

Thus, it is the primary object of the invention to provide a structure the manufacture of which is possible with considerable facility.

A further object of the invention is to provide an air flow metering device to one end of which both the fuel inlet and outlet flow lines are attached thereby freeing the other end for further purposes.

Still another object of the invention is to provide a construction in which total fuel flow is controlled by a metering valve provided in the air flow element thereby preventing the formation of gas bubbles in the metering valve.

Yet another object of the invention is to provide the hub of the air flow element with a bore into which the fuel metering valve may be positioned prior to assembly of the device with the induction tube.

These and other objects, features and advantages will be made more apparent to those skilled in the art from the following more detailed description and a study of the appended drawings.

DESCRIPTION OF THE PREFERRED EMBODIMENT

Figure 1:
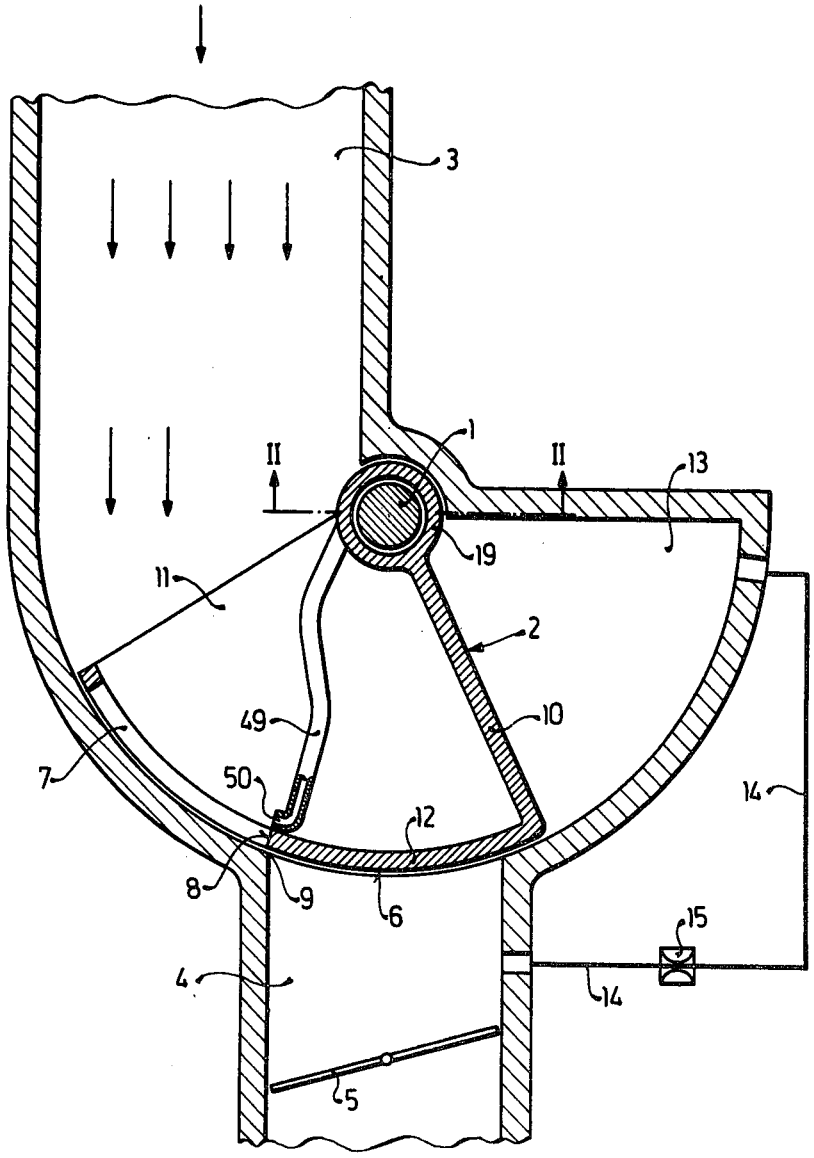
FIG. 1 is a section along the line I—I of FIG. 2 of an induction tube and the pivotal air flow rate meter contained therein.

Turning now to FIG. 1, there will be seen a cross section of a portion of an induction tube of an internal combustion engine containing a pivotal shaft 1 and mounted thereon a pivotal element 2, for example an air flow rate meter for sensing the air flow through the induction tube and responding thereto by an appropriate pivotal motion about the shaft 1. In operation, the air required for combustion flows through the induction tube in the direction of the arrows through a region 3 of the induction tube containing the air flow rate meter 2 and continues through an induction tube region 4 containing an arbitrarily settable throttle valve 5 to one or several cylinders (not shown) of an internal combustion engine. The air flow rate meter 2 pivots about a fixed shaft 1 mounted transversely in the induction tube. The air flow rate meter is a pivoting body in the shape of a cylindrical sector having an opening 7 in the curved end face 6 remote from the pivotal shaft 1. As the air flow increases and the pivotal element 2 rotates in a counterclockwise direction, the relative overlap of the opening 7 and the induction tube region 4 provides a flow cross section of variable size defined between the edge 8 of the opening 7 of the pivotal element on the one hand and the corner 9 of the induction tube. The pivotal element 2 is open in the direction of air flow and contains a cavity defined by a radial wall 10 transverse with respect to the air flow and side walls 11 aligned with the air flow. The pivotal element is further defined by a curved cylindrical wall 12 with the previously mentioned surface 6. The pivotal element 2 moves in the induction tube region 3 with very tight radial play, preventing any substantial air flow between the walls of the pivotal element and the induction tube. During opening motions of the air flow meter 2, the transverse wall 10 enters a damping chamber 13 which communicates through a line 14 and a damping throttle 15 with the induction tube region 4 downstream of the air flow meter 2. As a consequence, induction tube pressure oscillations due to piston suction strokes do not have any practical influence on the angular position of the air flow meter 2. The rotary motion of the air flow meter 2 in the induction tube region 3 is a linear function of the air flow rate. If the air pressure upstream of the flow meter 2 remains constant, then the air pressure between the flow meter 2 and the throttle valve 5 also remains constant.

Figure 2:
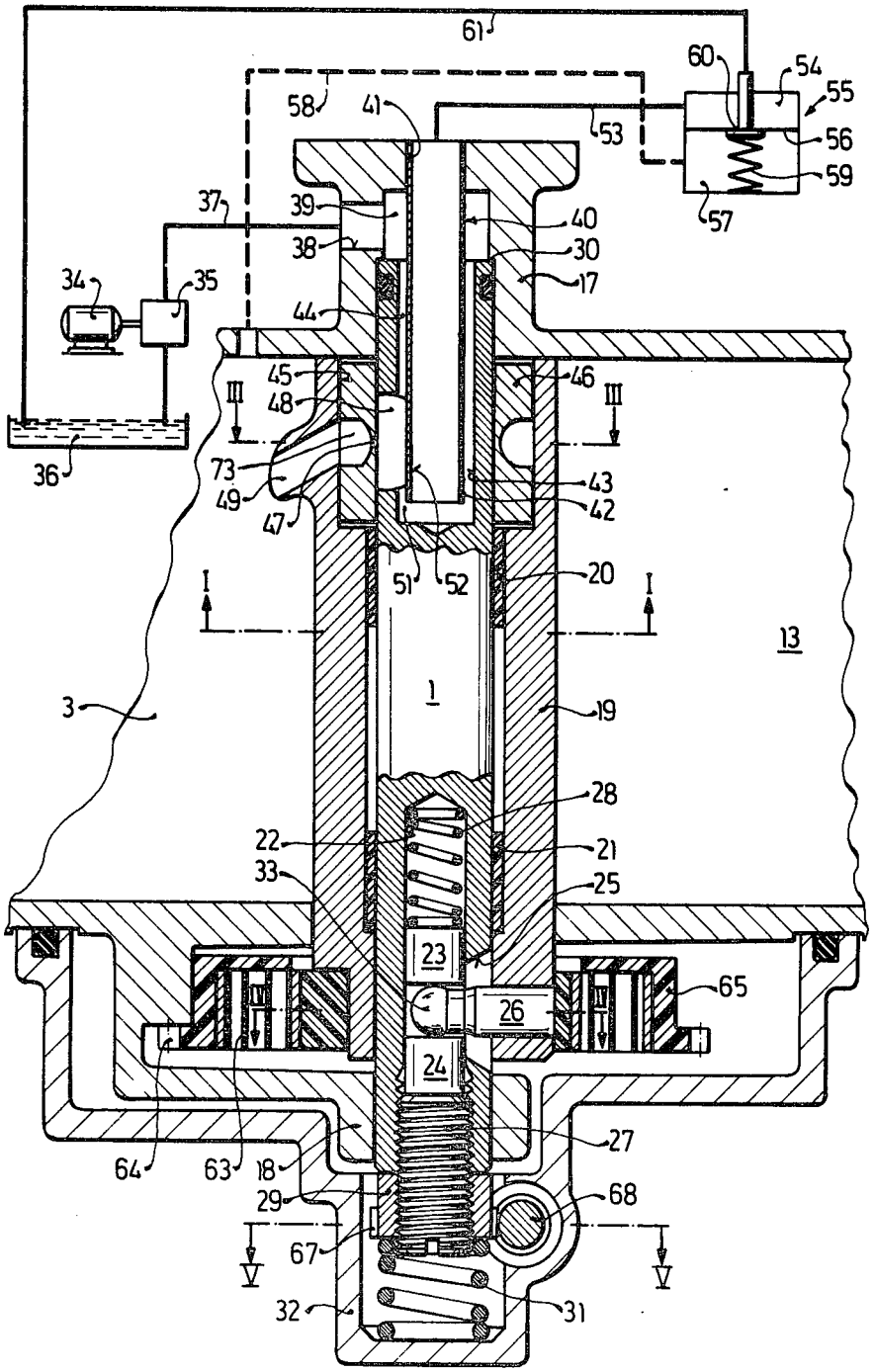
FIG. 2 is a section along the line II—II in FIG. 1 of an air flow meter and its supporting shaft as well as the axial alignment mechanism according to the invention.

FIG. 2 illustrates in detail how the shaft 1 is mounted within the induction tube and the manner in which the air flow meter 2 is mounted on the shaft 1. As illustrated there, the shaft 1 is carried snugly in two bearings 17, 18 capable of rotation therein. Surrounding the shaft 1 coaxially is a hub 19 on which is mounted the air flow meter 2. The hub 19 is carried on the shaft 1 over preferably Teflon-coated sleeve bearings 20, 21. The axial orientation of the hub 19 and the pivotal member 2 mounted thereon is insured by a pin 26 pressed fixedly in the hub 19 and passing through a recess 25 in the shaft into an axial blind bore 22 in the pivotal shaft 1. The blind bore 22 further contains two guide elements 23, 24 located on axially opposite sides of the guide pin 26. The recess 25 in the shaft 1 is of sufficient size to permit a rotation of the hub with respect to the shaft by approximately 60°. The relative axial position of the guide elements 23, 24 and hence of the guide pin 26 held thereby is insured by an adjustment screw 27 moving in the screw threads in the shaft 1 and bearing against one of the guide elements 24 while the second guide element 23 is urged in the opposite direction by a spring 28 supported in the blind end of the bore 22 and urging the guide element 23 against the guide pin 26. The presence of the compression spring 28 insures that the axial play is taken up and that stresses due to axial oscillations are avoided. The guide elements 23, 24 may be, as shown in FIG. 2, cylindrical rollers in which case the part 33 of the guide pin in contact with the guide elements 23 and 24 may be spherical.

A counter nut 29 threaded on the adjustment screw 27 fixes the relative position of the screw with respect to the shaft 1. The position of the shaft 1 within its own bearings is fixed by a spring 31 which forces the counter nut 29 against a shoulder 30 of the shaft bearing 17. A cover 32 provides support for the opposite end of the spring 31. As is illustrated in FIG. 2, the air flow meter 2 may be the air flow measuring part of a fuel injection system and serve for the direct actuation of a fuel metering valve. In that case, as shown by way of example in FIG. 2, an electric motor 34 drives a fuel pump 35 which aspirates fuel from a fuel tank 36 and feeds it through a line 37 and an opening 38 in the bearing 17 to an annular groove 39 within the bearing 17. The inside diameter of the annular groove 39 is defined by a tube 40 whose end 41 is pressed into the bearing 17 and whose opposite end 42 extends concentrically into an axial bore 43 within the shaft 1. The axial bore 43 is on the same center line but at the opposite end of the shaft from the blind bore 22. The diameter of the axial bore 43 is larger than that of the tube 40 so that there is formed an annular gap 44 through which fuel may flow from the groove 39 between the tube 40 and the wall of the bore 43. Fuel metering is performed by providing within a central interior bore 45 of the hub 19 a short slotted bushing 46 the inside diameter of which is penetrated by a control slot 47 which overlaps a connecting slot 48 in the shaft 1 to varying degrees (see also FIG. 3). Accordingly, the fuel metered at the control slot 47 flows through a fuel line 49 which may terminate near the edge 8 of the air flow element 2 in the vicinity of the aperture 7, and may be provided with an injection nozzle 50 for injecting fuel into the induction tube at the orifice defined by the control edge 8. Fuel injection could also take place through several injection nozzles or an injection slit. Any remaining fuel flowing through the annular slit 44 flows out of the annular opening 51 defined between the end of the axial bore 43 and the end of the tube 40 and continues through the interior of the tube 40, i.e., past the wall 52, whence it travels through a line 53 to the first chamber 54 of a pressure control valve 55. This pressure valve 55 maintains a constant pressure drop across the control slot 47. For this purpose, a diaphragm 56 defines a first chamber 54 and a second chamber 57 which communicates through an air line shown in dashed lines with the induction tube region 3 upstream of the air flow meter 2. Accordingly, the chamber 57 experiences the same pressure as prevails downstream of the control slot 47. The chamber 57 further contains a spring 59 which urges the diaphragm 56 to close against the terminus of a fuel return line 61 providing a valve seat 60. The force of the spring 59 could be changed in dependence on operational characteristics of the engine, for example by a solenoid, not shown. Additional forces could be applied in dependence on operational variables in parallel with the spring 51 to act directly on the diaphragm 56. The fuel flow scheme described above offers the significant advantage that the entire fuel quantity flows through the region of fuel metering and thus immediately flushes away any gas bubbles formed there. The pivotal motion of the air meter 2 is opposed by a spiral spring 63 one end of which is affixed to the hub 19 while the other end is coupled to a ring 65 provided with gear teeth 64. A pinion, not shown, can rotate the geared ring 65 and set screws, not shown, can be used to fit it in a given position.

Figure 5:
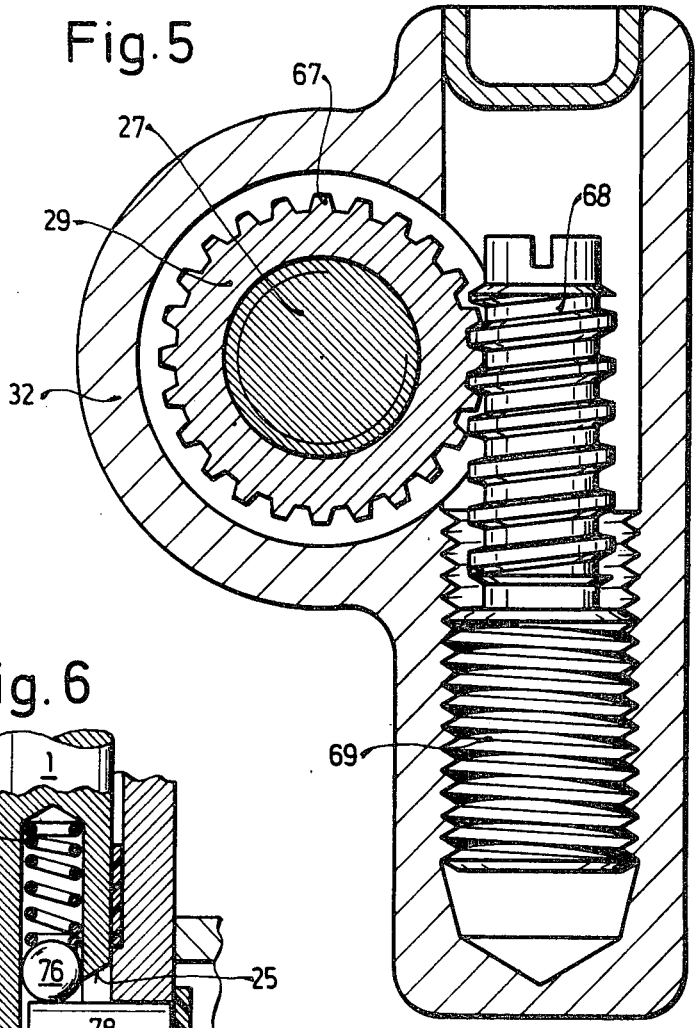
FIG. 5 is a section along the line V—V in FIG. 2.

Provision is further made for a basic adjustment of the fuel quantity metered out through the control slot 47 by adjustment of the relative position of the shaft 1 and the air flow meter 2. For this purpose, as is best seen in FIG. 5, the counter nut 29 is provided with gear teeth which engage a worm gear 68. As also shown in FIG. 5, the worm gear is disposed on a screw which also has screw threads in the opposite sense of the worm 68 with slightly higher pitch than those of the latter. Thus, during a rotation of the screw, only the difference of the pitches of the worm and the screw are effective in turning the counter nut 29, thereby providing a very sensitive method of adjusting the position thereof.

Figure 3:
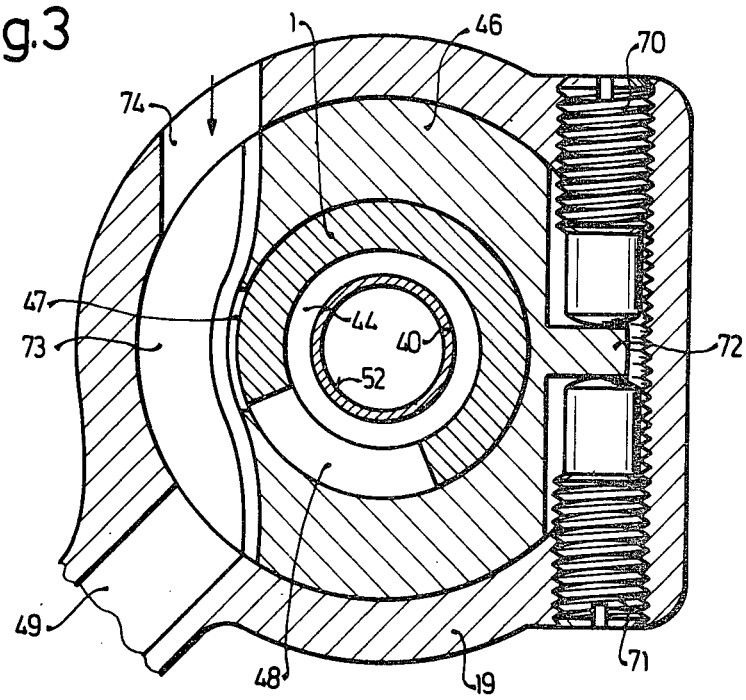
FIG. 3 is a section along the line III—III of FIG. 2.

As illustrated in detail in FIG. 3, the pivotal motions of the air flow meter 2 are transmitted to the slotted bushing 46 by means of two screws 70, 71 which engage opposite faces of a protrusion 72 of the slotted bushing 46 and thus permit an adjustment of the relative position of the two parts. It has been shown to be advantageous to provide additional air prior to injection to the fuel metered out as between the control slot 47 and the connecting slot 48. For this purpose, there is provided an air hole 74 in the bushing 19 communicating with the induction tube region 3 upstream of the air flow meter 2 and also communicating through a groove 73 in the slotted bushing 46 with the control slot 47. The addition of air to the metered out fuel prior to injection results in an improved mixture preparation.

Figure 4:
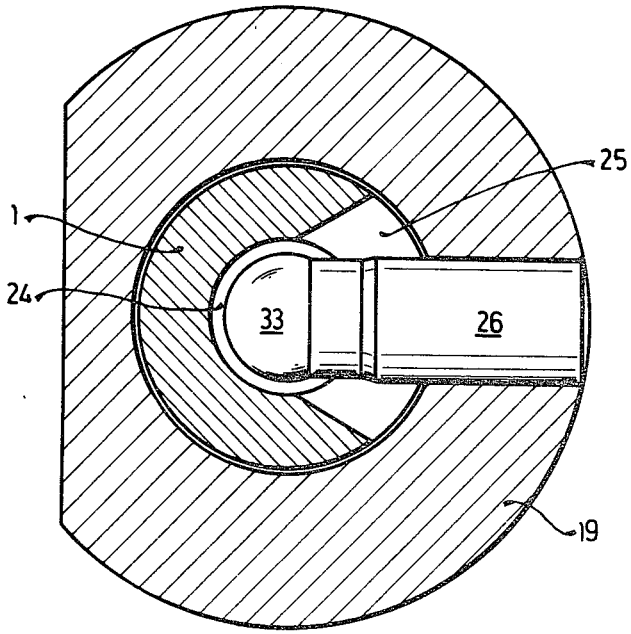
FIG. 4 is a section along the line IV—IV in FIG. 2.
Figure 6:
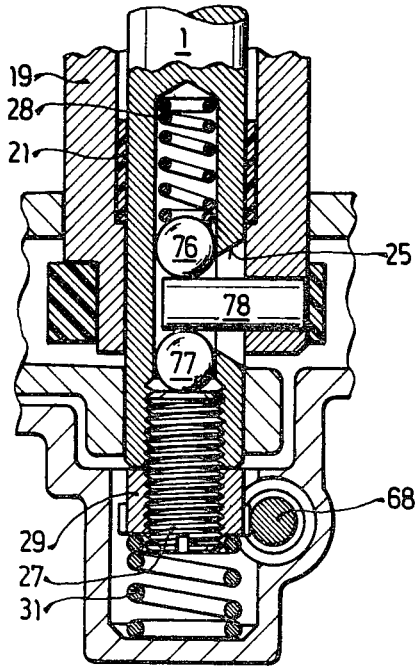
FIG. 6 is a detail of a second variant of an axial alignment mechanism according to the invention.

FIG. 4 is a detailed illustration showing the recess 25 in the shaft 1 and the relative pivotal motion of the guide pin 26 permitted thereby. The axial position of the air flow meter 2 on the shaft 1 may also be insured by elements of different configuration than the elements 23 and 24 of FIG. 1. For example, as illustrated in FIG. 6, the guide elements may be in the shape of spheres 76, 77 while the guide pin 78 would be embodied as a cylindrical bolt. A cylindrical bolt 78 could also be used in place of the spherical ended bolt 26 of the embodiment of FIG. 2. In the embodiment of FIG. 6, the guide pin 78 could also have a rectangular cross section.

The pivotal mechanism described above according to the present invention results in a guidance with reduced friction in both radial and axial directions involving the use of relatively inexpensive parts and permitting great facility of installation and adjustment. The fact that the mechanism which adjusts the relative axial position of the air flow meter is located at only one end of the pivotal shaft provides the advantage that the other end face of the pivotal shaft is available for association with other devices, for example hydraulic lines, as described above.

The foregoing relates to merely preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for an internal combustion engine, said engine being of the spark plug ignited type and including an induction tube comprising:

bearing means supported in said induction tube, a fixed shaft extending transversely of said induction tube arranged in said bearing means and baffle plate means rotatably supported on said shaft;

elastic means for urging said baffle plate means to oppose the force exerted on it by the air flow through said induction tube;

further characterized by said baffle plate means including a bore, fuel metering bushing means in said bore, said shaft being provided with a blind bore, tubular means inserted in said blind bore in said shaft in proximity to said fuel metering bushing means and means adjacent said tubular means for introducing fuel to said fuel metering bushing means and pressure control valve means for returning unused fuel flowing from said fuel metering bushing means to an associated fuel supply source.

2. A fuel injection system as claimed in claim 1, in which said shaft includes a slotted area adapted to control the apportionment of fuel flow to said fuel metering bushing.

3. A fuel injection system as claimed in claim 2, in which said fuel metering bushing means includes a control slot that permits fuel to flow thereto from said slotted area of said shaft.

4. A fuel injection system as claimed in claim 1, in which said fuel metering bushing means is rotatably adjustable relative to said shaft.

5. A fuel injection system as claimed in claim 4, in which said baffle plate means includes an integral hub and means correlated with said hub for rotating said fuel metering bushing means.

6. A fuel injection system as claimed in claim 1 wherein said fuel metering bushing means includes an annular channel disposed medially of its length and a fuel line adapted to communicate with said annular channel.

* * * * *